US008496538B1

(12) United States Patent
Tyler

(10) Patent No.: US 8,496,538 B1
(45) Date of Patent: Jul. 30, 2013

(54) TILTING GOLF PRACTICE PLATFORM

(76) Inventor: Nelson Tyler, Van Nuys, CA (US)

( * ) Notice: Subject to any disclaimer, the term of this patent is extended or adjusted under 35 U.S.C. 154(b) by 150 days.

(21) Appl. No.: 12/930,567

(22) Filed: Jan. 11, 2011

(51) Int. Cl.
*A63B 69/36* (2006.01)

(52) U.S. Cl.
USPC ..... 473/279

(58) Field of Classification Search
USPC ..... 473/278, 279; D21/781, 791
See application file for complete search history.

(56) References Cited

U.S. PATENT DOCUMENTS

| | | | | |
|---|---|---|---|---|
| 4,875,684 | A * | 10/1989 | Benilan | 473/279 |
| 5,308,075 | A * | 5/1994 | Theriault | 473/279 |
| 5,333,876 | A * | 8/1994 | Goto | 473/134 |
| 5,340,111 | A * | 8/1994 | Froelich | 473/279 |
| 5,431,406 | A * | 7/1995 | Ishii | 248/396 |
| 5,470,074 | A * | 11/1995 | Hotchkiss et al. | 473/279 |
| 6,179,724 | B1 * | 1/2001 | Yang et al. | 473/279 |
| 6,514,152 | B1 * | 2/2003 | Huang et al. | 473/279 |
| 7,766,764 | B2 * | 8/2010 | Malhotra | 473/279 |
| 8,142,305 | B2 * | 3/2012 | Hackenberg | 473/278 |
| D663,001 | S * | 7/2012 | Newell | D21/791 |
| 2009/0137334 | A1 * | 5/2009 | Malhotra | 473/279 |

* cited by examiner

*Primary Examiner* — Raleigh W Chiu
(74) *Attorney, Agent, or Firm* — Colin P. Abrahams

(57) ABSTRACT

A tilting platform assembly comprises a base member having a dome shaped upper surface portion, and a platform member having an upper playing surface and a concave shaped lower surface portion, the concave shaped lower surface portion corresponding substantially with the dome shape upper surface portion of the base member and being movable relative thereto. A mechanism is provided for selectively fixing and releasing the dome shaped upper surface portion of the base member relative to the concave shaped lower surface portion of the platform member to permit the top playing surface to be disposed at a plurality of different orientations.

19 Claims, 6 Drawing Sheets

TILTING GOLF PRACTICE PLATFORM

FIELD AND BACKGROUND OF THE INVENTION

This invention relates to a golf practice platform. More particularly, the invention relates to a golf practice platform which can be adjusted by the user so that at least a portion of the surface can be adjusted to be at different orientations relative to the horizontal. In this way, the golfer is able to practice on a surface which can more accurately emulate the conditions on a regular golf course and tailor his or her golf game to the actual environmental variations commonly found on golf courses.

In the past, there have been several attempts to create a golf tee-off practice device where the surface thereof can be adjusted in some way so as to vary its angle relative to the horizontal in order to provide a reality based practice device for golfers. For the most part, it appears that these devices are unwieldy, difficult to operate and are usually so heavy that they must essentially remain in one location because of the difficulty in moving them. They may require complicated and expensive hydraulic mechanisms to operate, electrical power for motors associated with the device, and metal framework to support the weight of the platform surface as well as the golfer when practicing. The golf practice platform of the present invention has a configuration and manner of operation which avoids many of the cumbersome features of existing golf practice platforms.

Therefore, various devices for tilting golf practice platforms have been proposed although there does not seem to be any presently in use at golf driving ranges. This absence of such tiltable platforms is probably due to their complexity, the high expenses for manufacturing, installation, operation and maintenance. They are, for these reasons alone, too expensive to be popular at conventional facilities for golfers. The devices which can be identified, as mentioned, use means such as hydraulics, belts, pulleys, motors, gears, shafts, multiple wedge shaped rings and the like to achieve their ability to vary the platform surface angle in some way. However, this complexity of construction will add unwanted height to the platform. Not only are they expensive to make but they also do not lead to zero or minimal maintenance or longevity. This is aggravated by the fact that these types of devices tend to spend their lifetime in the open, exposed to the elements, sun, rain, snow, dirt, sand and other degrading factors. Their parts and operation therefore deteriorate over time, making an investment in this type of apparatus questionable.

SUMMARY OF THE INVENTION

According to one aspect of the invention, there is provided a tilting platform assembly comprising: a base member having a dome shaped upper surface portion; a platform member having an upper playing surface and a concave shaped lower surface portion, the concave shaped lower surface portion corresponding substantially with the dome shape upper surface portion of the base member and being movable relative thereto; and means for selectively fixing and releasing the dome shaped upper surface portion of the base member relative to the concave shaped lower surface portion of the platform member to permit the top playing surface to be disposed at a plurality of different orientations.

Preferably, the lower surface portion of the platform member comprises thereon a plurality of non-slip rubber feet, and a plurality of spring-loaded bar assemblies formed on the lower surface portion of the platform member.

According to another aspect of the invention, there is provided a tilting platform assembly comprising: a base member having a substantially dome shaped portion and a substantially central opening in the dome shaped portion; a platform member which is substantially flat and mounted on the base member so as to be movable relative thereto to permit the platform member to be disposed at a plurality of different orientations; and a release and secure assembly operable between a first unlocked position wherein the platform member can be moved relative to the base member and a second locked position wherein the platform member is fixed relative to the base member.

In one embodiment, the release and secure assembly comprises a locking wheel having a threaded shaft which extends through the central opening in the dome shaped portion, and a locking plate below the dome shaped portion of the base member which has a threaded bore for receiving the threaded shaft, wherein the tightening of the locking wheel causes the locking plate to move toward the platform member and abut and engage the dome shaped portion of the base member to prevent relative movement between the base member and platform member, and the loosening of the locking wheel causes the locking plate to move away from the platform member and disengage the dome shaped portion of the base member to permit relative movement between the base member and the platform member.

In another embodiment, the release and secure assembly comprises a locking plate, a handle movable between a first locking position and a second unlocking position, the handle having a cam surface, and a connector portion between the handle and the locking plate, wherein rotation of the handle between the first locking position and second unlocking position moves the locking plate into and out of engagement with the base member to respectively prevent and permit relative movement between the platform member and the base member.

In yet another form, the release and secure assembly comprises a lock plate in the dome shaped portion of the base member, a locking lever accessible to a user of the platform assembly, and a cable extending between the lock plate and the locking lever, the locking lever being movable between a first locked position wherein the cable is tensioned to cause engagement of the lock plate against the base member to prevent relative movement between the base member and the platform member, and a second unlocked position wherein the tension in the cable is slackened to cause disengagement of the lock plate from the base member and permit relative movement between the base member and the platform member.

According to another aspect of the invention, there is provided a method of adjusting the orientation of a golf practice platform, the method comprising: placing a base member having a dome shaped upper surface on a substrate; mounting a platform member on the base member, the platform member having a top plane surface and a concave shaped lower surface portion which corresponds with the dome shaped upper surface portion of the base member; and selectively fixing and releasing the dome shaped upper surface of the base member relative to the concave shaped lower surface portion of the platform member so that the top playing surface can be selectively disposed at a plurality of different orientations.

This present invention therefore comprises a practicing aid for use by golfers who can, using the invention, practice driving golf balls while effectively standing on uneven or sloping ground surfaces as often happens in reality on the golf course fairway. Many golf courses will also have a "driving range" where golfers can practice driving golf balls as if from the starting tee-off position on the golf course itself. But these driving positions are almost always on substantially level ground. The only time the golfer may get to practice shots in an off level situation is actually during a golf game, where normal fairway conditions prevail.

The present invention therefore comprises an adjustable and tilting golf practice platform, that is preferably placed at or near a driving range, or in any other location for that matter, where the golfer can adjust the platform or surface thereof to various selected angles, stand on the platform, place the ball on the platform as well, and then practice driving such golf balls. This will allow and help the golfer to acquire the proper motor skills and expertise to cope with his body adjusting to an uneven stance, without having to be on an actual golf course. The golfer can continue to practice the same or similar shots on the uneven platform many times over to improve his or her skills, without being on a golf course where this type of activity would not be appropriate. Golfers are under constant pressure to keep moving on the golf course to prevent backups and delays for other golfers coming up behind them, so that repeatedly practicing shots from an uneven surface is for all practical purposes not possible on a regular golf course.

In one embodiment of the invention, the golf practice platform may comprise two basic components, namely, a base member and a movable platform mounted on the base member. The platform itself will preferably have no bearings, shafts, wires, motors, hydraulics or other unwieldy hardware on or attached to it, which tends to make its use impractical and expensive. Preferably, the base may be comprised of a lightweight but strong material such as for example stainless steel or aluminum, while the platform may be made of a material such as fiberglass. Both of these materials have properties which are well adapted to surviving and weathering the gamut of outdoor conditions.

In one form, the base may be a symmetrical dome-shaped structure with tabs appropriately placed thereon to be mounted to the ground in order to provide stability to the device. The platform will preferably be mounted on top of the dome shaped base structure. The platform will conveniently have a concave underside which will substantially match with and correspond to the curve and configuration of the dome. The platform may, in accordance with one aspect of the invention be held slightly raised from and off the surface of the dome by a plurality, preferably at least three, sliders which can be made of a material such as Teflon®.

In one form of the invention, these sliders are comprised of roller balls that are spring loaded, as will be described, with just enough force to lift the weight of the platform off the dome shaped structure. This will allow sufficient clearance between the dome and a plurality of rubber non-slip pucks or feet which are mounted to the underside of the platform. This combination of sliders and feet or pucks will allow the platform to be manually moved by effortlessly sliding it over the dome to a desired degree of tilt both in pitch or roll axes, as long as no person is standing on the platform. When the golfer has thus set the angle and orientation of the platform relative to the base, he or she then stands on the platform. The weight of the golfer will thereafter compress the spring loaded sliders until the rubber feet or pucks make contact with the dome. Due to the pressure of the multiple non-slip pucks exerted on the fairly gentle curve of the dome, the platform is then effectively locked in place on the dome, and relative movement between the dome structure and the platform is effectively prevented.

When the golfer steps off the platform, the platform is raised off the surface of the dome by the sliders and is freely movable thereover to be located to another position and angle.

The drawings to be described show one embodiment of a typical layout of the slider units and the rubber pucks or feet mounted on the underside of platform to facilitate the action and operation of the invention in one of its forms.

Note that on the top surface of the platform there may be an area or portion where synthetic lawn or other suitable material can be glued or otherwise applied in order to simulate a golf course playing surface. This will provide a more realistic and true to life playing condition for the golfer to practice his drives. Furthermore, the top surface of the platform may have a sunken area or recess in order to hold a supply of golf balls ready for use by the golfer without having to change his position too significantly in order to make the practice session more useful.

DETAILED DESCRIPTION OF THE INVENTION

Figure 1:
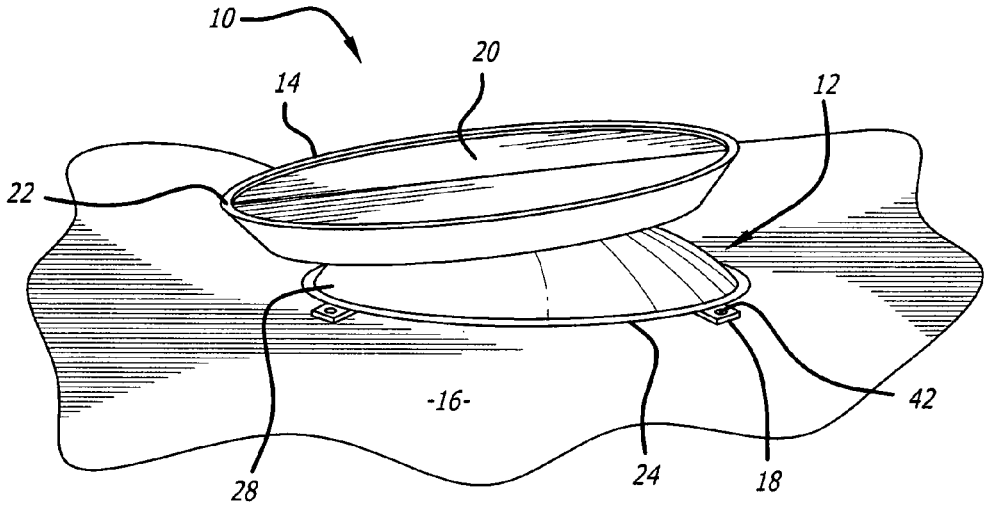
FIG. 1 is a perspective view of a tilting golf practice platform in accordance with one aspect of the present invention.

The tilting golf practice platform of the invention will now be described with reference to the drawings. With reference to FIG. 1 of the drawings, the tilting golf practice platform 10 of the invention is essentially comprised of a dome base 12 and a platform 14. The dome base 12 of the practice platform 10 is placed on a surface 16 and may be secured thereto by fastening mounting tabs 18 formed on the dome base 12 to the surface 16 so as to prevent any sliding or movement of the dome base 12 on the surface 16. The dome base 12, while movable in the sense that it can be placed in any desired position without being permanently fixed to it, is, during operation of the practice platform 10, at least temporarily secured to the surface 16.

The platform 14 rests upon the dome base 12 and can be moved relative thereto. The platform 14 has an upper surface 20 and when the platform 14 is moved relative to the dome base 12, the orientation of the upper surface 20 relative to the horizontal, which would typically be the surface 16, a selected orientation of the upper surface 20 can be achieved. A golfer then stands on the upper surface 20 of the platform 14 and the selected orientation of the upper surface 20 will emulate the lie of the golf course thus enabling the golfer to practice shots, such as at a golf driving range, in a manner which would more accurately reflect actual conditions on a golf course.

Figure 2:
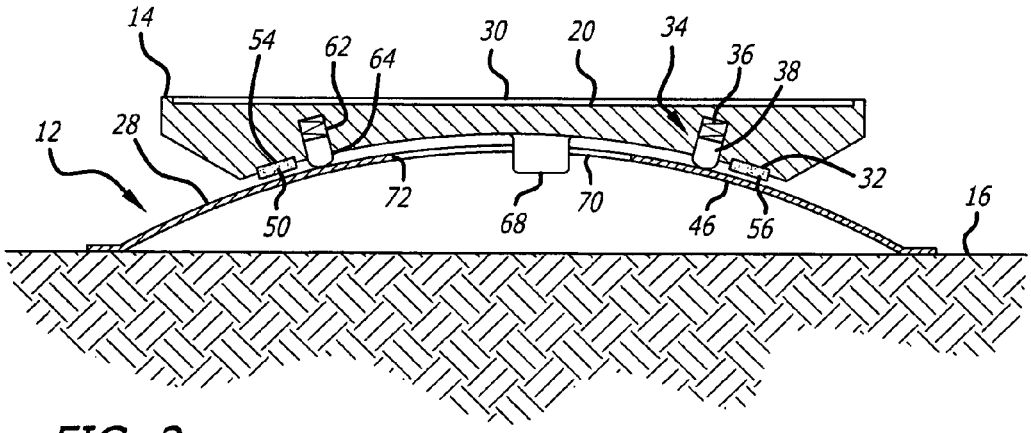
FIG. 2 is a cross-section through the tilting golf practice platform shown in FIG. 1 of the drawings.

FIG. 2 of the drawings shows the dome base 12 resting on a surface 16. The dome base 12 has a circumferential rim 24, with a plurality of tabs 18 extending outwardly from the circumferential rim 24. Each tab 18 has an aperture 42 therein and, using a nail, screw or other type of fastener, the dome base 12 can be releasably attached to the surface 16, as desired.

It will be seen in FIG. 2 of the drawings that the dome base 12 includes a dome support surface 28 generally of arcuate shape, and preferably shaped so as to correspond in part to the circumference of a circle. The dome base 12 may be comprised of a metal, strong plastic or other suitable material, which is able to adequately support not only the platform 14, but also the weight of a person standing on the platform 14.

The platform 14 has a lower surface 46, which is concave in shape, and, like the dome support surface 28, has a shape which corresponds in part to the circumference of a circle. It will be seen from the drawings that the arcuate shape of the dome support surface 28 and the lower surface 46 of the platform 14 are substantially the same, thus enabling the platform 14 to slide over the dome support surface 28 in a manner to be described.

Figure 3:
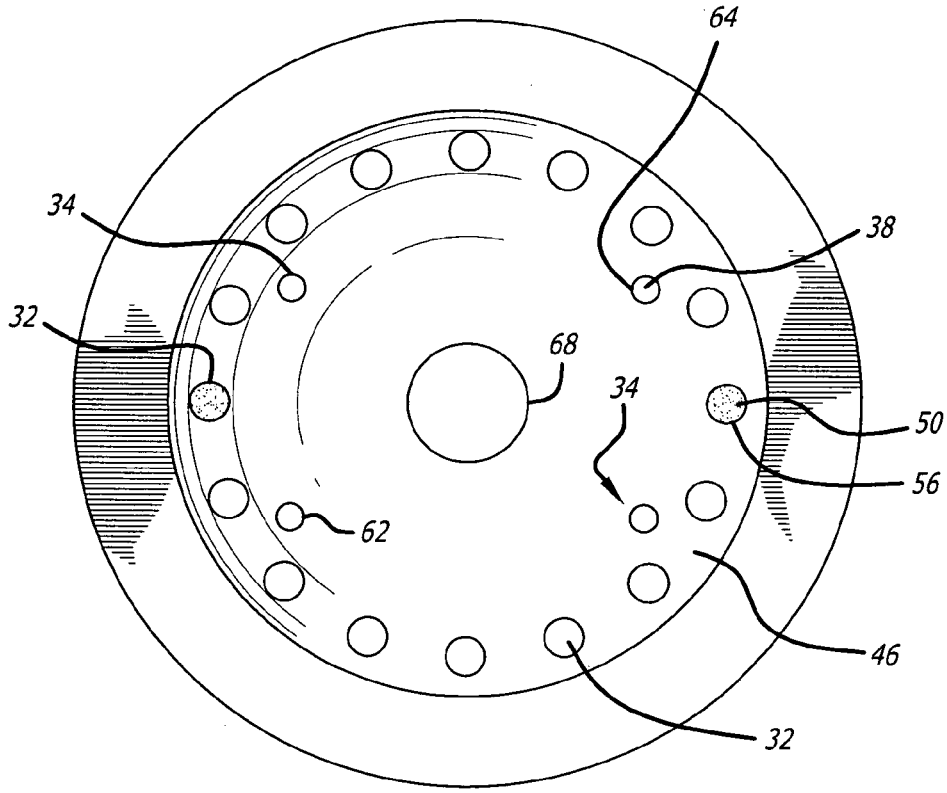
FIG. 3 is a bottom view of the golf platform shown in FIG. 1 of the drawings.

The lower surface 46 of the platform 14 has mounted thereon a plurality of non-slip rubber pucks or feet 50. These are more or less equi-spaced in a circular configuration at a position near the edge of the lower surface 46. Each of the feet 50 is preferably mounted within an appropriate recess 54 in the lower surface 46 of the platform 14. Each of the feet 50 extends outwardly from the lower surface 46 by a small distance so that when the platform 14 is mounted on the dome support surface 28 a contact surface 56 of the feet 50 rests on the dome support surface 28. Since the feet 50 are comprised of a non-slip, preferably rubber material, the platform 14 will not move relative to the dome base 12 when the contact surface 56 of the feet 50 is resting on the dome support surface 28. While the size of each of the feet 50 is small, there are sufficient feet 50 located on the lower surface 46 of the platform 14 to ensure that the combined effect of the contact surfaces 56 on the dome support surface 28 keeps the platform 14 from moving relative to the dome base 12. In FIG. 3 of the drawings, the relative size and number of the feet 50 is illustrated in accordance with one aspect of the invention. Furthermore, the location of these feet on the lower surface 46 is also shown. However, it will be appreciated that different embodiments of the invention may show a different number of feet 50, and their location and size may also vary according to specific design parameters. Further, any one platform 14 may have on its lower surface 46 feet 50 of different sizes and shapes, selectively located to provide optimal effect.

The platform 14 has formed therein a plurality of chambers 62, as shown in FIG. 2 of the drawings. In the embodiment shown in FIG. 3 of the drawings, there are four equi-spaced chambers 62. Each of the chambers 62 has an opening 64 in the lower surface 46 of the platform 14. Each of the chambers 62 accommodates a spring-loaded bar assembly 34. The spring-loaded bar assembly 34 comprises a spring 36 and a bar 38. The bar 38 may comprise a roller ball or some other suitable structure which will serve the purpose, to be described below.

As best seen in FIG. 2 the drawings, the spring-loaded bar assembly 34 is configured so that the spring 36 is located in the chamber 62, and the bar 38 is located partially inside of the chamber, and extends partially outside the chamber 62 beyond the opening 64. The spring 36 urges the bar 38 outwardly from the chamber 62. Preferably, in one embodiment of the invention, the bar 38 may include tabs or stops which prevent the bar 38 from falling out of the chamber 62. Generally, the bar 38 is movable between a first position in which it extends out from the chamber 62, and a second position wherein it is pushed more into the chamber 62 against the bias of the spring 36.

The spring 36 is selected so as to have sufficient force so as to raise the platform 14 off the dome support surface 28 when no additional weight is placed on the upper surface 20 of the platform 14. Furthermore, the bar 38, or at least a portion thereof, is preferably coated with Teflon® or some other suitable material so as to enable it to slide easily over the dome support surface 28. In this way, a user of the golf practice platform 10 can easily move the platform 14 of the dome support surface 28 of the dome base 12 by lightly pushing it in the desired direction so that the upper surface 20 of the platform 14 will be in the desired orientation so as to emulate many of the non-horizontal surfaces typically encountered on a conventional golf course.

When the platform 14 is situated relative to the dome base 12 in a suitable position favored by the user, the user will then step onto the upper surface 20 of the platform 14. The weight of the user will cause the bars 38 to be pushed by the dome support surface 28 into the chambers 62, against the bias of the spring 36. When this happens, the contact surfaces 56 of the feet 50 will engage the dome support surface 28, and since the feet 50 are comprised of a non-slip material, the platform 14 will become fixed relative to the dome base 12. In this way, the upper surface 20 of the platform 14 will be situated at the desired orientation by a simple adjustment, and will become fixed in that position when the user stands on the upper surface 20 of the platform 14. Conversely, as soon as the user steps off the platform 14, the action of the springs 36 will push the bars 38 toward the outside of the chambers 62 thus raising the feet 50 off the dome support surface 28 of the dome base 12. The platform 14 will, in this situation, once more the cable of orientation adjustment when the user pushes or pulls the platform 14 relative to the dome base 12 to another desired position.

As will best be seen in FIG. 2 of the drawings, the platform 14 has a projection 68 extending downwardly from the lower surface 46 thereof. The height of the projection 68 measured downwardly from the lower surface 46 is greater than the distance between the dome base 12 and the platform 14 which is normally created by the action of the spring-loaded bar assembly 34 when it is raising the platform 14 off the dome base 12. The dome support surface 28 has a circumferential opening 70 therein and the projection 68 is able to move around in the opening 70 which is of larger dimension than the projection 68. The projection 68 and opening 70 interaction provides limits to the extent of movement of the platform 14 on the dome base 12. In essence, the opening 70 is bordered by an edge 72, which represents the thickness of the dome base 12. The projection 68 is free to move within the opening 70, but eventually, the projection 68 will come into contact with the edge 72 defining the opening 70. It will be appreciated that the projection 68 will not be able to move beyond the opening 70, and this in turn limits the extent of movement of the platform 14 on the dome base 12, to which the projection 68 is connected.

The upper surface 20 of the platform 14 may have formed thereon synthetic lawn 30. However, any alternative covering, such as carpeting, plastic or other material may be used. Preferably, the lawn 30 may be easily removed and replaced in order that it may be periodically cleaned or completely replaced when worn.

Figure 7:
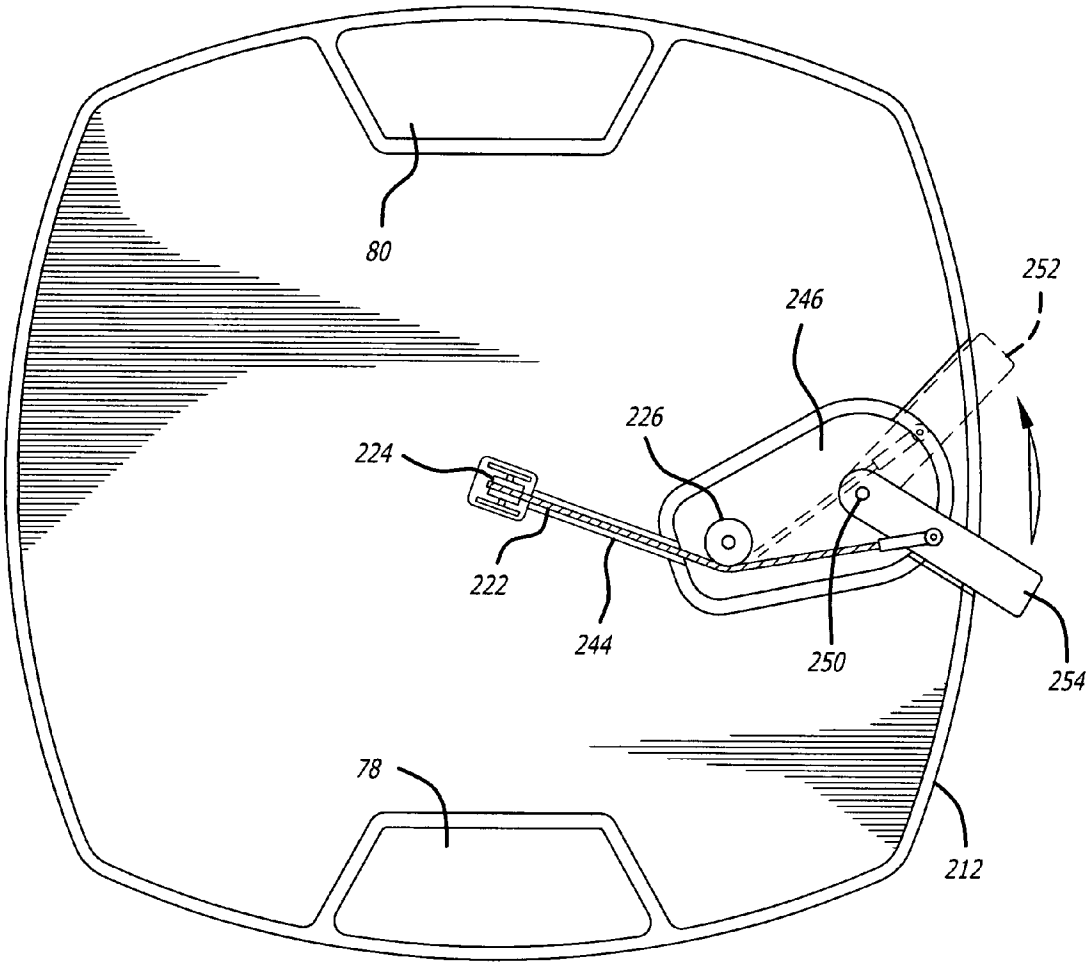
FIG. 7 is a top view of a golf practice platform in accordance with one aspect of the present invention.

FIG. 7 of the drawings shows a top view of a golf platform in accordance with one aspect of the invention. In this figure, there is shown an alternative locking mechanism by means of which the platform can be secured to the dome base, as will be described further below. However, this figure also shows the upper surface of the golf platform 10 of the invention which includes a defined ball tray 78 and 80, which can also be utilized by the golf player to temporarily hold in a convenient manner those objects which may be related to golf practice.

Figure 4:
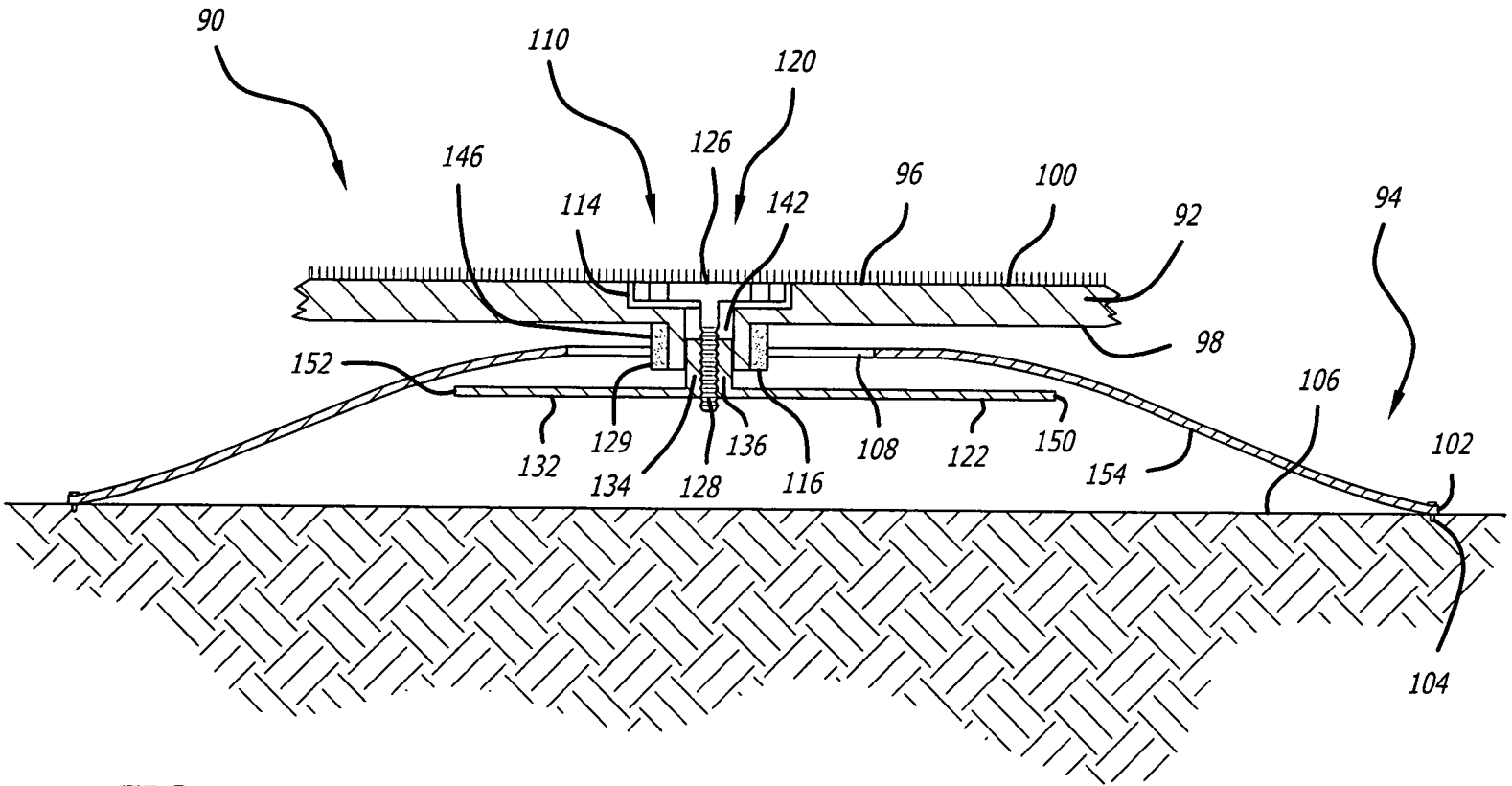
FIG. 4 is a cross-section through a golf practice platform in accordance with a further embodiment of the invention.

In FIG. 4 of the drawings, another embodiment of the invention is illustrated. In this figure, there is shown a golf practice platform 90 compromising a platform 92 and a dome base 94, the dome base 94 preferably being comprised of a stainless steel material. The platform 92 has an upper surface 96, a lower surface 98 and a fake grass or covering 100 formed thereon. The platform 92 is substantially planar or flat. The dome base 94 includes an outer rim 102 having a plurality of apertures therein, and through which a nail, bolt or screw 102 may be placed in order to temporarily secure the dome base 94 to a surface 106. The dome base 94 has substantially centrally located therein an opening 108 through which at least a part of a release and secure assembly 110 can pass. By appropriate operation of the release and secure assembly 110, to be described below, the position of the platform 92 can be selectively adjusted so that the orientation of the upper surface 96 can be varied according to the user's need.

The platform 92 has on its upper surface 96 a recess 114, and on its lower surface 98 a circular wall 116.

The release and secure assembly 110 is comprised of a locking wheel threaded shaft 120 which connects to a locking plate 122. The locking wheel threaded shaft 120 is comprised of a wheel 126, which is received within the recess 114 of the platform 92, and a threaded shaft 128 which passes through an aperture 127 in the platform 92 and engages the locking plate 122. The locking plate 122 comprises a plate 132 and a housing 134, the housing 134 having an internal threaded bore 136 which receives the threaded shaft 128. The housing 134 is received within the space 142 defined by the circular wall 116. A rubber bumper 146 is located about the outside of the circular wall 116.

The position of the platform 92 relative to the dome base and 94 can be easily and effectively adjusted using the release and secure assembly 110. In order to move the platform 92 relative to the dome base 94, the user will rotate the wheel 126 which has the effect of lowering the locking plate 122. The platform 92 is then manually moved to the desired orientation. At that point, the wheel 126 is turned so that the shaft 128 engages more tightly and more securely within the internally threaded bore 136. As it does so, the locking plate 122 is raised and eventually the edges 150 and 152 engage the lower surface 154 of the dome base 94. When the wheel 126 has been sufficiently turned and tightened, the locking plate 122 will engage the dome base 94 with sufficient force so as to prevent further movement of the platform 92 relative to the dome base 94.

The size of the opening 108 limits the extent of movement of the platform 92 relative to the dome base 94. When the platform 92 has been moved to a position wherein the rubber bumper 146 engages the edge of the opening 108, further movement of the platform 92 will be prevented. It should be appreciated that the size of the opening 108 will determine the extent of orientation from the horizontal which may be permitted by a particular golf practice platform 90.

Figure 5:
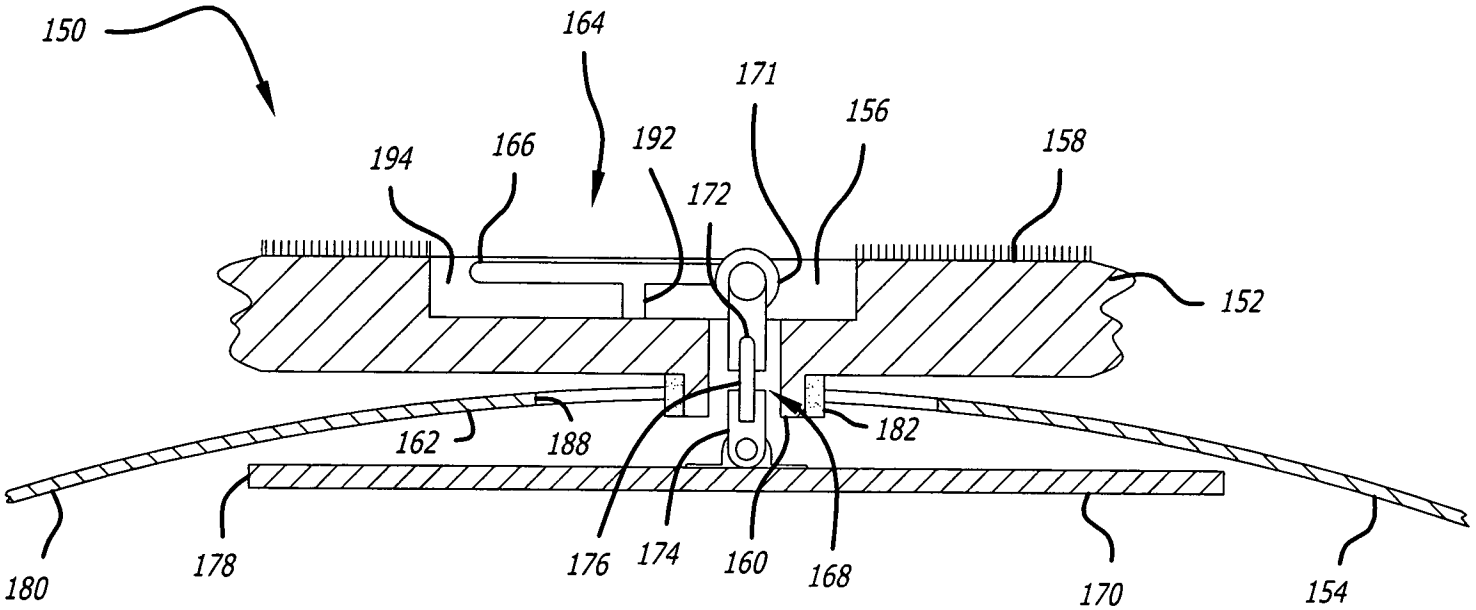
FIG. 5 is a detailed cross-sectional view of certain components of the golf practice platform shown in FIG. 4 of the drawings.

FIG. 5 of the drawings shows yet a further embodiment of a golf practice platform in accordance with the invention. In this figure, there is shown a golf practice platform 150 comprising a platform 152 and a dome base 154. The platform 150 has a recess 156 on its upper surface 158 and a circular wall 160 extending from the lower surface 162. A release and secure assembly 164 is provided, and comprises a handle 166, a connector mechanism 168, and a locking plate 170. The handle 166 is pivotable and has a cam surface 171 which engages with the connector mechanism 168. The connector mechanism 168 includes a first portion 172 which engages with the cam surface 171, a tie rod 174, and a connector bolt 176. The tie rod 174 principally connects to the locking plate 170, the locking plate 170 having edge 178. As was the case shown in FIG. 4 of the drawings, the edge 178 of the locking plate 170 can selectively engage with the lower surface 118 of the dome base 154. A rubber bumper 182 surrounds the circular wall 160, and contacts the dome base 154 at the edge of an opening 188 which is substantially centrally located in the dome base 154. As previously described, the opening 188 determines by its size and shape the limits of movement of the platform 152 relative to the dome base 154.

In operation, the mechanism illustrated in FIG. 5 of the drawings is operated by moving the handle 166 between a first locked position which is illustrated in FIG. 5 of the drawings, and an unlocked position, which is achieved by rotating the handle 166 through approximately 90° in a clockwise direction. When moved between the first locked position and the second unlocked position, the cam surface 171 formed on the handle 166 will cause the connector mechanism 168 to be raised or lowered. It is raised in the first locked position, and lowered in the second unlocked position. By raising and lowering the connector mechanism 168, the locking plate 170 is correspondingly raised and lowered. When in the raised position, the edge 178 of the locking plate 170 will engage the lower surface 180 of the dome base 154, fixing the platform 152 relative to the dome base 154. When the handle 166 is moved upward to the unlocked position, the locking plate 170 will be lowered away from the dome base 154, allowing the user to move the platform 152 to the desired position and orientation, and then fix it in that position and orientation by rotating the handle 166 and thereby causing the edges 178 to engage the dome base 154 and thereby secure the platform 152 relative to the dome base 154.

Other features to note in respect of the golf practice platform 150 illustrated in FIG. 5 of the drawings include a tab 192 which abuts against the floor of the recess 156 thereby ensuring a space 194 below the handle 166 when in the locked position, enabling the user to more easily grip the handle 166. The platform 152 has fake grass 196, a carpet, or other suitable material on the upper surface 158. Further, the rubber bumper 182 engages the dome base 154 at the edge of the opening 188, absorbing energy when bumping into the dome base 154, to facilitate the comfort of the user when moving the platform 152 into the desired position.

Figure 6:
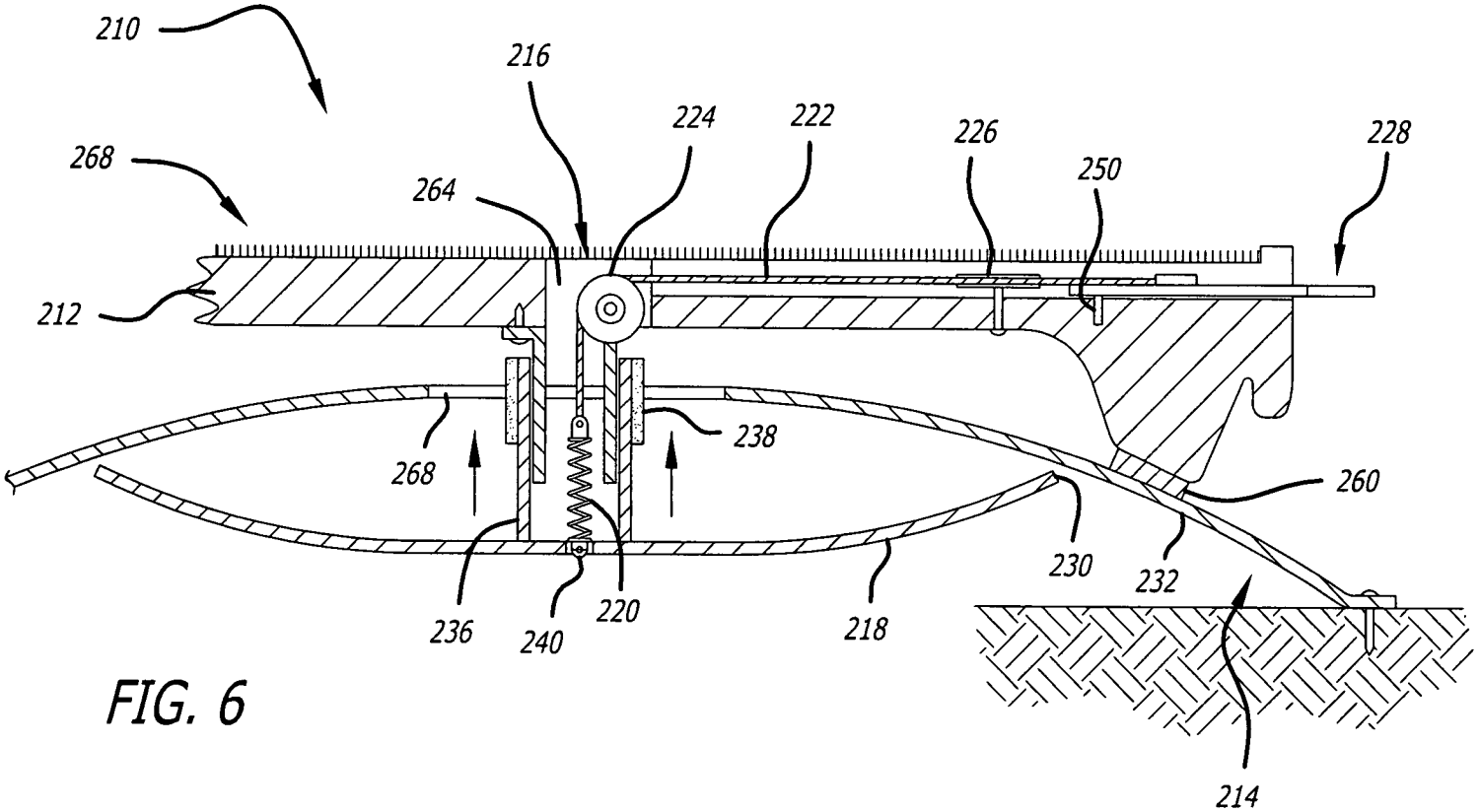
FIG. 6 is a detailed view showing a locking mechanism for securing together relatively movable components of the golf practice platform in accordance with a further embodiment of the invention.

Reference is now made to FIG. 6 of the drawings which shows yet a further embodiment of a golf practice platform in accordance with another aspect of the invention. The golf practice platform 210 comprises a platform 212 and dome base 214, as in previous embodiments described herein. Note that FIG. 7 of the drawings shows for the most part a top view of the golf practice platform shown in this FIG. 6, with certain components, to be described, exposed for clearer illustration of this embodiment of the invention.

The embodiment shown in FIG. 6 of the drawings includes a release and secure assembly 216 by means of which the platform 212 can be moved relative to the dome base 214 by the user, and locked in the desired position. The release and secure assembly 216 comprises a lock plate 218, a spring 220, a cable 222, a first pulley 224, a second pulley 226, and a lever lock 228. It will be seen that the lock plate 218 has slightly concave ends, and has an edge 230 which engages the undersurface 232 of the dome base 214 as has been described in previous embodiments. The locking plate 218 further comprises a substantially central cylindrical wall 236 and a rubber bumper 238 which surrounds at least a part of the cylindrical wall 236, having a function already described above.

The spring 220 is connected to the center of the lock plate 218 by means of a pin or bolt 240. At its other end, the spring 220 is connected to one end of the cable 222. The other end of the cable 222 is pivotally connected to the lock lever 228, at about its center. Between the spring 220 and the lock lever 228, the cable 222 passes over the first pulley 224 and around the second pulley 226 before it reaches the lock lever 228. As will be seen in FIG. 7 of the drawings, the cable 222 is accommodated in a slot 244 so that it is below the surface of the platform 212.

A recess area 246 is formed in the upper surface of the platform to 212, and the recess area 246 accommodates the second pulley 226 as well as a part of the lock lever 228. The lock lever 228 is connected pivotally at its one end 250, and is rotatable about the end 250 between a first locked position 252 and a second unlocked position 254. It will be seen by the relative positioning of the second pulley 226 and the lever lock 228 that when the lever lock 228 is in the lock position 252 it will provide additional tension to the cable 222. When moved to the unlocked position 254, that tension will be released, slackening the cable 222. When the lock lever 228 is in the lock position 252, the edge 230 of the lock plate 218 will engage the dome base 214, and when the lock lever 228 is in the unlocked position 254, the lock plate 218 will not be in contact with the dome base 214. It therefore follows that the platform 212 can be moved relative to the dome base 214 when the lock lever 228 is locked, and such movement will be prevented when the lock lever 228 is in the unlocked position.

Is to be noted that the platform 212 has attached thereto a puck 260 which is designed and selected so as to easily slide over the dome base 214. Other structural features of the golf practice platform 210 include a through hole 264 which accommodates the first pulley 224, and allows the cable 222 to pass from the lower side of the platform 212 to the upper side thereof. Further, the dome base 214 includes the opening 268 of the type described in previous embodiments to limit the extent of movement of the platform 212 relative to the dome base 214. The rubber bumper 238 absorbs and softens any shockwaves which may otherwise result when the cylindrical wall 236 impacts the edge of the dome base 214 which borders the opening 268.

It will also be seen, based in FIG. 7 of the drawings, that a portion of the locking lever 228 extends beyond the outer periphery of the platform 212 thereby placing it in easy and convenient reach of the user. The dome base 214 itself has a peripheral rim with attachment mechanisms which can be used to releasably secure the dome base 214 to the ground or other surface. The upper surface of the platform 212 may be covered with grass 268, carpet or other suitable material, as desired.

The invention is not limited to the details described herein, and various modifications and embodiments may be made to the golf practice platform of the invention.

The invention claimed is:

1. A tilting platform assembly comprising:

a base member having a dome shaped upper surface portion and a peripheral rim including an attachment mechanism for releasably attaching the tilting platform assembly to a surface;

a platform member having an upper playing surface and a concave shaped lower surface portion, the concave shaped lower surface portion corresponding substantially with the dome shape upper surface portion of the base member and being movable relative thereto; and means for selectively fixing and releasing the dome shaped upper surface portion of the base member relative to the concave shaped lower surface portion of the platform member to permit the top playing surface to be disposed at a plurality of different orientations.

2. A tilting platform assembly as claimed in claim 1 wherein the lower surface portion of the platform member comprises thereon a plurality of non-slip rubber feet.

3. A tilting platform assembly as claimed in claim 2 wherein the rubber feet are located near the edge of the lower surface portion in a circular configuration.

4. A tilting platform assembly as claimed in claim 1 further comprising a plurality of spring-loaded bar assemblies formed on the lower surface portion of the platform member.

5. A tilting platform assembly as claimed in claim 4 wherein the spring-loaded bar assemblies are each housed in a chamber, the chamber having an opening in the lower surface portion of the platform member.

6. A tilting platform assembly as claimed in claim 5 wherein the spring-loaded bar assemblies each comprise a spring in the chamber and a bar partially in the chamber and partially outside of the chamber, the spring urging the bar towards the outside of the chamber.

7. A tilting platform assembly as claimed in claim 6 wherein the force of the spring in the spring-loaded bar assembly is sufficient to slightly raise the platform member off the base member when there is no weight on the top playing surface of the platform member, but wherein the force of the spring is not sufficient to raise the platform member when a person is standing on the top playing surface of the platform member.

8. They tilting platform assembly as claimed in claim 1 wherein the base member has a central opening therein, and the platform member has a projection extending downwardly from the lower surface portion into the central opening of the base member, the projection and central opening limiting the extent of movement of the platform member relative to the base member.

9. A tilting platform assembly comprising:

a base member having a substantially dome shaped portion and a substantially central opening in the dome shaped portion;

a platform member which is substantially flat and mounted on the base member so as to be movable relative thereto to permit the platform member to be disposed at a plurality of different orientations; and a release and secure assembly operable between a first unlocked position wherein the platform member can be moved relative to the base member and a second locked position wherein the platform member is fixed relative to the base member, wherein the release and secure assembly comprises a locking wheel having a threaded shaft which extends through the central opening in the dome shaped portion, and a locking plate below the dome shaped portion of the base member which has a threaded bore for receiving the threaded shaft, wherein the tightening of the locking wheel causes the locking plate to move toward the platform member and abut and engage the dome shaped portion of the base member to prevent relative movement between the base member and platform member, and the loosening of the locking wheel causes the locking plate to move away from the platform member and disengage the dome shaped portion of the base member to permit relative movement between the base member and the platform member.

10. A tilting platform assembly as claimed in claim 9 wherein the locking plate has a housing thereon which contains the threaded bore and the platform member has on the lower surface thereof a cylindrical wall for accommodating the housing.

11. A tilting platform assembly as claimed in claim 10 further comprising a rubber bumper surrounding the cylindrical wall on the platform member.

12. A tilting platform assembly as claimed in claim 9 wherein the locking wheel is housed in a recess formed in the upper surface of the platform member.

13. A tilting platform assembly as claimed in claim 9 wherein the release and secure assembly comprises a locking plate, a handle movable between a first locking position and a second unlocking position, the handle having a cam surface, and a connector portion between the handle and the locking plate, wherein rotation of the handle between the first locking position and second unlocking position moves the locking plate into and out of engagement with the base member to respectively prevent and permit relative movement between the platform member and the base member.

14. A tilting platform assembly as claimed in claim 13 further comprising a recessed space in the platform for receiving the handle.

15. A tilting platform assembly as claimed in claim 13 wherein the connector portion passes through the central opening in the dome shaped portion.

16. A tilting platform as claimed in claim 9 wherein the release and secure assembly comprises a lock plate in the dome shaped portion of the base member, a locking lever accessible to a user of the platform assembly, and a cable extending between the lock plate and the locking lever, the locking lever being movable between a first locked position wherein the cable is tensioned to cause engagement of the lock plate against the base member to prevent relative movement between the base member and the platform member, and a second unlocked position wherein the tension in the cable is slackened to cause disengagement of the lock plate from the base member and permit relative movement between the base member and the platform member.

17. A tilting platform as claimed in claim 16 further comprising a first pulley for guiding the cable from a substantially vertical orientation to a substantially horizontal orientation, and a second pulley to bend the cable between the first pulley and the locking lever from a linear to a dogleg condition.

18. A tilting platform assembly as claimed in claim 9 further comprising at least one tray formed in an upper surface of the platform member.

19. A tilting platform assembly comprising:

a base member having a dome shaped upper surface portion;

a platform member having an upper playing surface and a concave shaped lower surface portion, the concave shaped lower surface portion corresponding substantially with the dome shape upper surface portion of the base member and being movable relative thereto;

means for selectively fixing and releasing the dome shaped upper surface portion of the base member relative to the concave shaped lower surface portion of the platform member to permit the top playing surface to be disposed at a plurality of different orientations; and a plurality of spring-loaded bar assemblies formed on the lower surface portion of the platform member.

* * * * *